US006438812B1

(12) United States Patent
Jansen

(10) Patent No.: US 6,438,812 B1
(45) Date of Patent: Aug. 27, 2002

(54) APPARATUS FOR INTERMINGLING MULTIFILAMENT YARNS

(75) Inventor: Peter-Bernhard Jansen, Gangelt (DE)

(73) Assignee: Heberlein Fibertechnology, Inc., Wattwil (CH)

( * ) Notice: Subject to any disclaimer, the term of this patent is extended or adjusted under 35 U.S.C. 154(b) by 102 days.

(21) Appl. No.: 09/679,290

(22) Filed: Oct. 6, 2000

(30) Foreign Application Priority Data

Oct. 6, 1999 (DE) ..... 199 47 894
Jul. 5, 2000 (DE) ..... 100 32 758

(51) Int. Cl.[7] ..... D02G 1/16; D02J 1/08
(52) U.S. Cl. ..... 28/274; 28/272
(58) Field of Search ..... 28/271, 272, 273, 28/274, 275, 276, 258, 220, 283, 254; 57/289, 350, 333, 908

(56) References Cited

U.S. PATENT DOCUMENTS 2,622,961 A * 12/1952 Finlayson et al. ..... 28/273
3,911,655 A * 10/1975 London et al. ..... 28/271
4,064,686 A 12/1977 Whitted et al.
4,069,562 A * 1/1978 Trifunovic et al. ..... 28/273
4,125,922 A * 11/1978 Irwin ..... 28/274
4,355,445 A * 10/1982 Matsumoto et al. ..... 28/274
4,417,375 A * 11/1983 Sano et al. ..... 28/272
4,535,516 A 8/1985 Egbers et al.
4,644,620 A 2/1987 Maeda
5,481,787 A * 1/1996 Sano et al. ..... 28/271
5,713,113 A 2/1998 Demir
6,134,759 A * 10/2000 Saijo et al. ..... 28/274
6,163,944 A * 12/2000 Lin ..... 28/271

FOREIGN PATENT DOCUMENTS

WO WO 82/00668 3/1982
WO WO 97/11214 3/1997

* cited by examiner

*Primary Examiner*—Amy B. Vanatta
(74) *Attorney, Agent, or Firm*—Oliff & Berridge, PLC

(57) ABSTRACT

Apparatus for intermingling multifilament yarns, having an intermingling assembly with a thread channel (3; 11), and at least one blowing channel (5', 5"; 6', 6") opening into the thread channel (3; 11), and capable of receiving compressed air, wherein the cross-section of each blowing channel (5', 5"; 6', 6") increases in the direction of the thread channel (3; 11) and the thread channel (3; 11) for each blowing channel (5', 5"; 6', 6") has a first segment (3') before the opening of the blowing channel (5', 5"; 6', 6"), a second segment (3") in the area of the opening of the blowing channel (5', 5"; 6', 6"), and a third segment (3'") after the opening of the blowing channel (5', 5"; 6', 6"), whereby the second segment (3") of the thread channel has larger cross-sectional areas than those of the first and third segments. Preferably, the second segment has a width and/or length that increase(s) at least portionwise from the opening of the blowing channel (5', 5"; 6', 6") into the thread channel (3; 11) in the direction of a wall of the thread channel opposite the opening.

26 Claims, 10 Drawing Sheets

APPARATUS FOR INTERMINGLING MULTIFILAMENT YARNS

BACKGROUND OF THE INVENTION

1. Field of Invention

The invention relates to an apparatus for intermingling multifilament yarns.

2. Description of Related Art

An apparatus of this kind is known from WO 82/00668, for example. The known apparatus has a thread channel with a generally constant cross-cross-section. In certain cases, the cross-cross-section of the thread channel can vary continuously or stepwise over its length. It can also have constrictions and/or local expansions. The blowing channel of this known apparatus is to have the form of a Laval nozzle.

The intermingling of multifilament yarns is significant because the intermingling promotes the integration of the filaments with one another, resulting in fewer disruptions of thread-guiding elements caused by protruding filaments during subsequent processing of the multifilament yarns. This applies equally for smooth and textured yarns. As a measure for assessing intermingled (or interlaced) yarns, the fixed points per meter of yarn and the mean and maximum opening lengths—the length between two successive intermingling points, also referred to as intermingling nodes—are determined. During subsequent processing of the yarns, however, stress placed on yarns such as by weaving causes a portion of the intermingling nodes to be removed, so that the mean and maximum opening lengths increase and the fixed points per meter of yarn decrease.

SUMMARY OF THE INVENTION

The object of the present invention is to provide an apparatus for intermingling multifilament yarns of the initially cited type that allows multifilament yarns to be intermingled such that the stability of the intermingling properties of these yarns changes as little as possible during subsequent processing.

This object is met by an apparatus for intermingling multifilament yarns, having an intermingling device with a thread channel and at least one blowing channel opening into the thread channel capable of receiving compressed air, wherein the cross-cross-section of each blowing channel increases in the direction of the thread channel and the thread channel for each blowing channel has a first segment before the opening of the blowing channel, a second segment in the area of the opening of the blowing channel, and a third segment after the opening of the blowing channel, whereby the second segment of the thread channel, perpendicular to the axis of the thread channel, has larger cross-cross-sectional areas than those of the first and third segments.

In particular, the width of the second segment increases at least portionwise from the opening of the blowing channel into the thread channel in the direction of a wall of the thread channel opposite the opening.

It has also proven practical for the second segment to have a length that increases at least portionwise from the opening of the blowing channel into the thread channel in the direction of a wall of the thread channel opposite the opening.

Away from the opening of the blowing channel, the expansion of the length and/or width can at first increase and then assume a constant dimension. However, it can also extend over the entire second segment of the thread channel up to the thread-channel wall opposite the blowing channel, whereby it is especially advantageous for the increase in the length and/or width to be continuous.

These measures allow an intermingling assembly to be provided in which the segment of the intermingling assembly in which the blowing channel opens into the thread channel exhibits a significant expansion of the thread channel such that the thread channel in this segment has a significantly larger width than that of the remaining thread channel segments before and after the opening of the blowing channel, and that the thread channel in this segment likewise expands from its base at least portionwise in the direction of the opposite wall of the thread channel. The width of the thread channel is understood to be the cross-cross-sectional dimension perpendicular to the thread channel axis and the blowing channel axis, and the length of the thread channel is understood to be the cross-cross-sectional dimension parallel to the thread channel axis. The base of the thread channel is understood to be the wall of the thread channel running along the side of the thread channel parallel to the thread channel axis, in which wall the opening of the blowing channel is located.

Surprisingly, it has been shown that this approach can, with little energy, produce a high fixed-point density with a high degree of uniformity for the yarns treated with the apparatus of the invention. In many cases, the intermingling can take place at a higher processing speed than when using conventional apparatus for intermingling multifilament yarns. Moreover, the intermingling points exhibit significantly better stability, i.e., the properties allowing assessment of the intermingled yarns undergo significantly less change, even after stressing of these yarns during subsequent processing, than is possible in intermingling using conventional apparatus.

BRIEF DESCRIPTION OF THE DRAWINGS

The invention will be explained in more detail with reference to the following figures.

DETAILED DESCRIPTION OF PREFERRED EMBODIMENTS

Figure 1A:
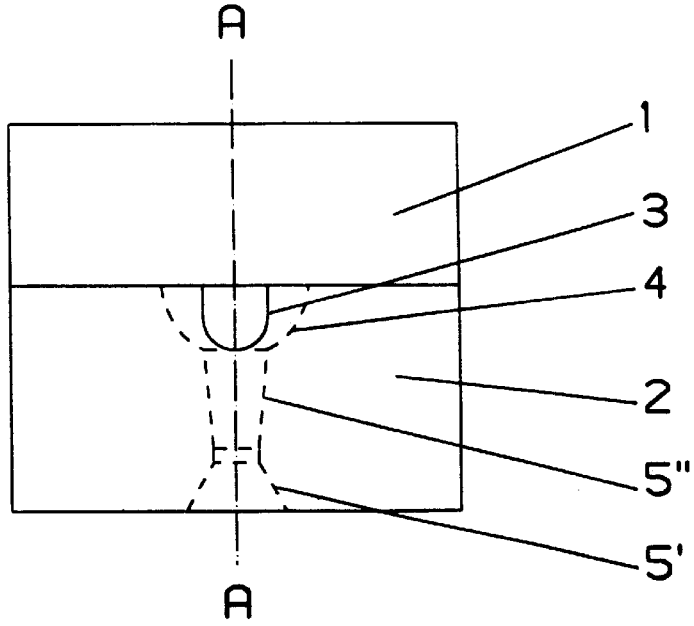
FIG. 1*a* shows the schematic construction of an intermingling assembly of the invention with a vertically oriented blowing channel, whereby the second segment of the thread channel has the shape of a spherical cap.
Figure 1B:
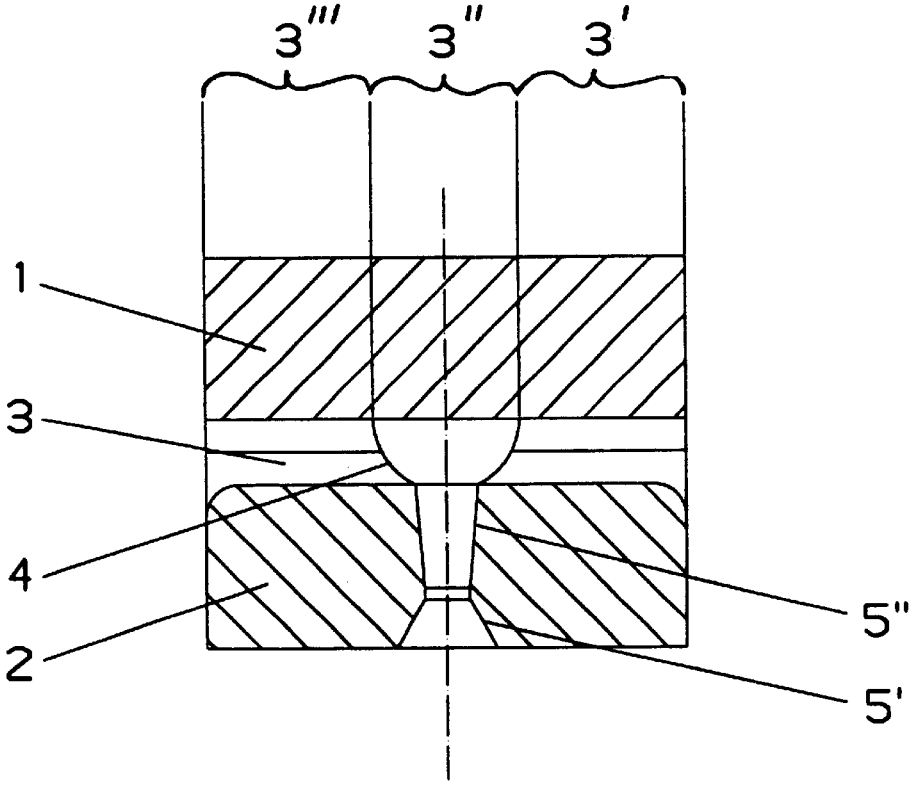
FIG. 1*b* shows cross-section AA of the intermingling assembly of FIG. 1*a;*
Figure 2A:
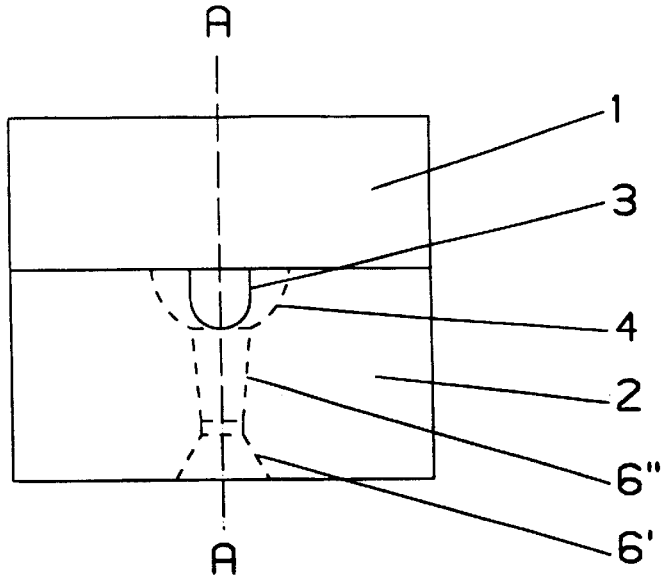
FIG. 2*a* shows the schematic construction of an intermingling assembly of the invention with a diagonally oriented blowing channel, whereby the second segment of the thread channel has the shape of a spherical cap.
Figure 2B:
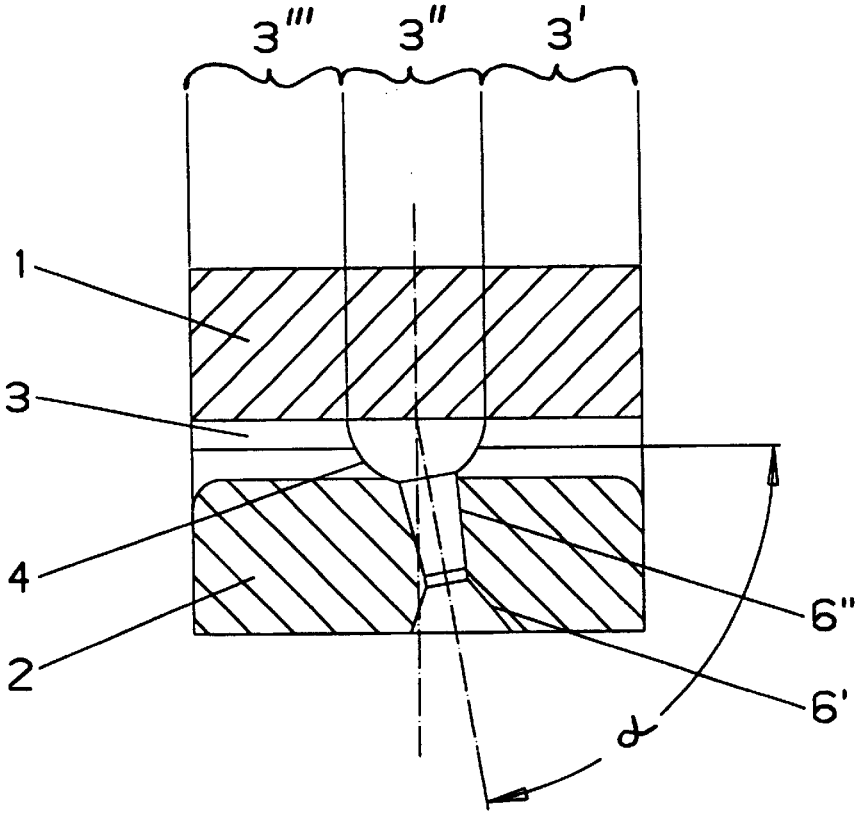
FIG. 2*b* shows cross-section AA of the intermingling assembly of FIG. 2*a;*

FIGS. 1*a* and 2*a* schematically represent an intermingling assembly or device of the invention in side view. For clarity, an apparatus accepting the intermingling assembly and a compressed-air supply to a blowing channel are not shown in FIGS. 1 to 6. The intermingling assembly consists of an upper part 1, which in the case shown represents a flat plate, and a lower part 2 having a thread channel 3. As indicated in FIGS. 1*b* and 2*b*, which show cross-section AA of FIGS. 1*a* and 2*a*, respectively, thread channel 3 has a first segment 3', a second segment 3", and a third segment 3'". Furthermore, the intermingling assembly has a blowing channel 5',5", and 6',6" whose cross-cross-section in the direction of the thread channel 3 initially decreases (5' and 6') and then increases (5" and 6").

The parts of the second segment 3" of thread channel 3 and blowing channels 5',5" and 6',6" that are arranged in the interior of the intermingling assembly are shown in side view in FIGS. 1*a* and 2*a*, respectively, as dashed lines. Thus, dashed contour 4 in FIGS. 1*a* and 2*a* depicts the width of the second segment 3" of thread channel 3 and contour 4 of FIGS. 1*b* and 2*b* depicts the length of the second segment 3" of thread channel 3. The contour of the second segment 3" of thread channel 3 is hemispherical, whereby the length and width of the contour 4 increase away from the blowing channels 5" and 6".

The intermingling assembly shown in FIGS. 1*a*, 1*b* has a blowing channel 5',5" whose axis is arranged perpendicularly to the longitudinal extent of thread channel 3 and perpendicularly to one surface of upper part 1 of the intermingling assembly, while the intermingling assembly shown in FIGS. 2*a*, 2*b* shows a blowing channel 6',6" whose axis is arranged at an angle a of less than 90° to the longitudinal extent of thread channel 3 and perpendicularly to one surface of upper part 1 of the intermingling assembly.

Figure 3A:
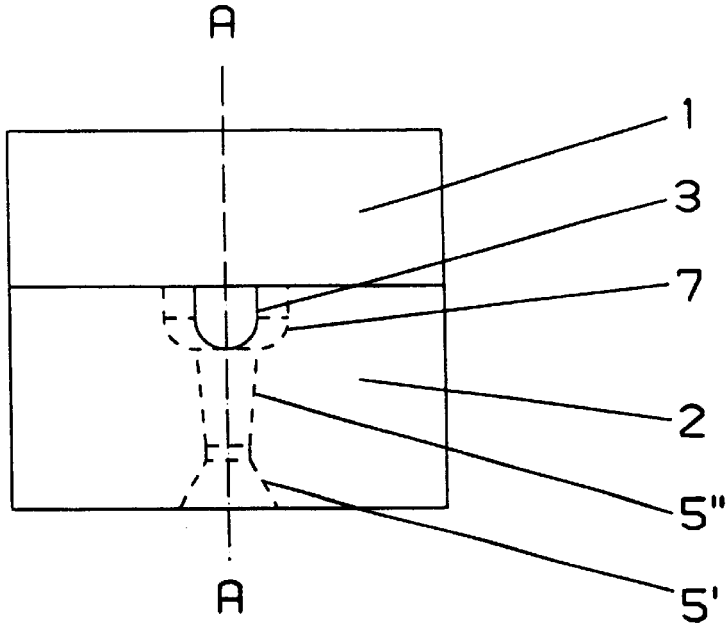
FIG. 3*a* shows the schematic construction of an intermingling assembly of the invention with a vertically oriented blowing channel, whereby each contour in the second segment of the thread channel has a U-shaped cross-cross-section.
Figure 3B:
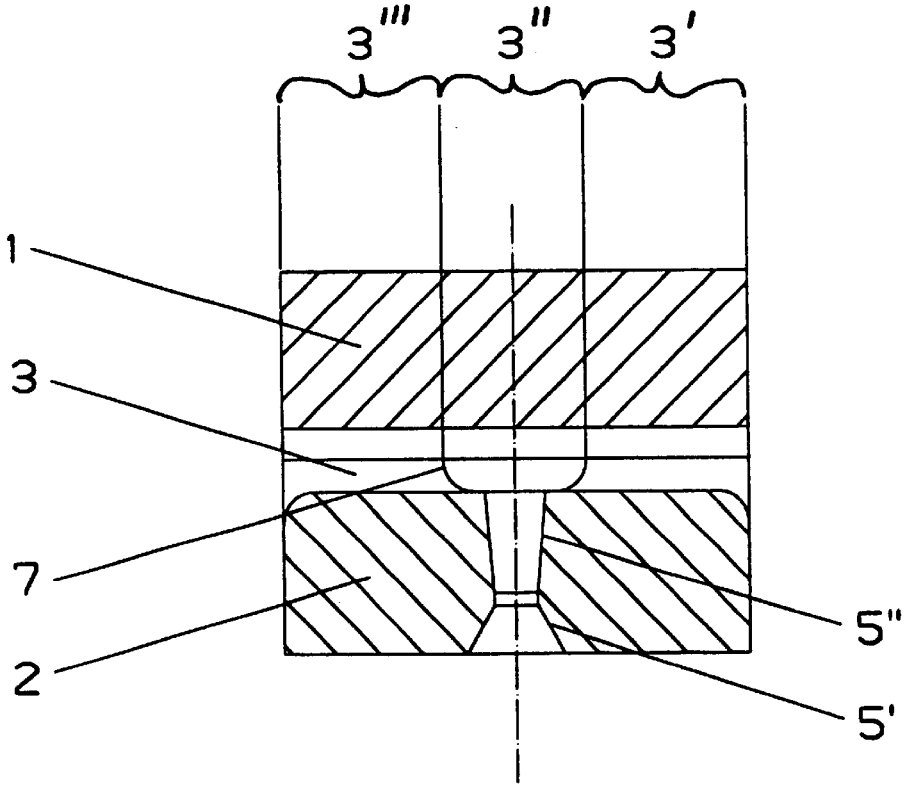
FIG. 3*b* shows cross-section AA of the intermingling assembly of FIG. 3*a;*
Figure 4A:
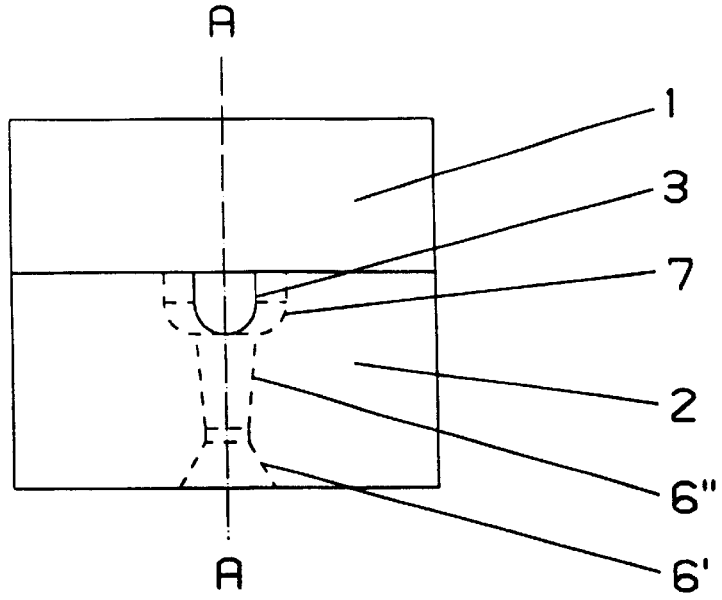
FIG. 4*a* shows the schematic construction of an intermingling assembly of the invention with a obliquely oriented blowing channel, whereby each contour in the second segment of the thread channel has a U-shaped cross-cross-section.
Figure 4B:
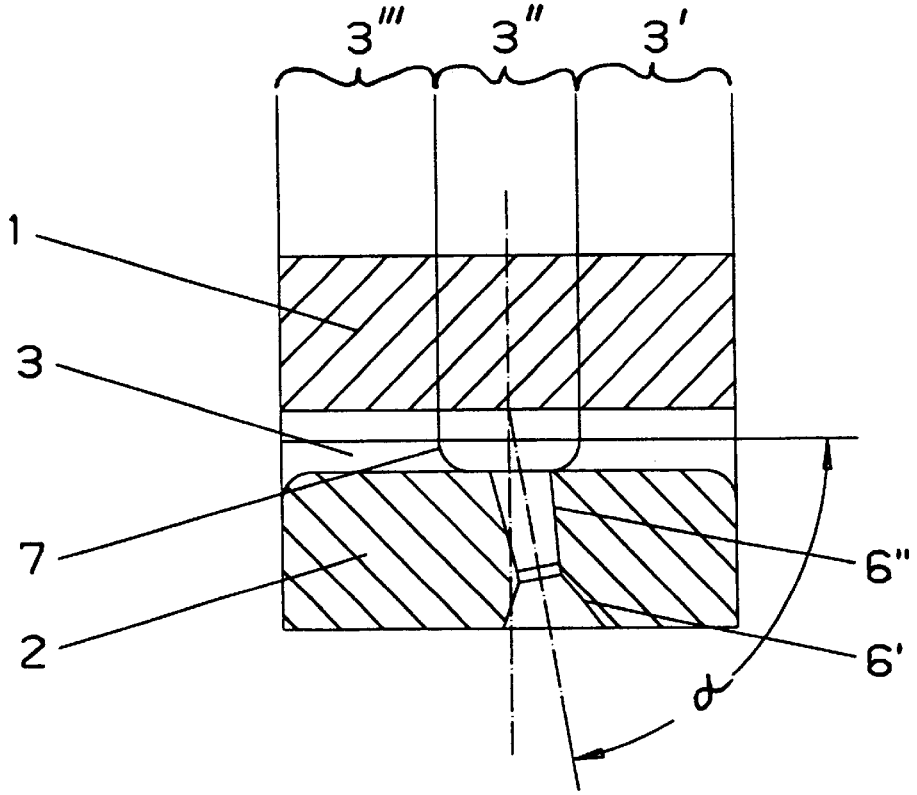
FIG. 4*b* shows cross-section AA of the intermingling assembly of FIG. 4*a;*

FIGS. 3*a* and 4*a* schematically represent an intermingling assembly of the invention in side view. The intermingling assembly consists of an upper part 1, which in the case shown is a flat plate, and a lower part 2 having a thread channel 3. As indicated in FIGS. 3*b* and 4*b*, which show cross-section AA in FIGS. 3*a* and 4*a*, thread channel 3 has a first segment 3', a second segment 3", and a third segment 3'". Furthermore, the intermingling assembly has a blowing channel 5',5" or 6',6" whose cross-cross-section in the direction of thread channel 3 initially decreases (5' and 6') and then increases (5" and 6").

The parts of the second segment 3" of thread channel 3 and blowing channels 5',5" and 6',6" that are arranged in the interior of the intermingling assembly are shown in side view in FIGS. 3*a* and 4*a*, respectively, as dashed lines. Thus, dashed contour 7 in FIGS. 3*a* and 4*a* depicts the width of the second segment 3" of thread channel 3 and contour 7 of FIGS. 3*b* and 4*b* depicts the length of the second segment 3" of thread channel 3. The contour of the second segment 3" of thread channel 3 has the shape of a U, whereby the length and width of contour 7 increase away from the blowing channels 5" and 6".

The intermingling assembly shown in FIGS. 3*a*, 3*b* has a blowing channel 5',5" whose axis is arranged perpendicularly to the longitudinal extent of thread channel 3 and perpendicularly to one surface of upper part 1 of the intermingling assembly, while the intermingling assembly shown in FIGS. 4*a*, 4*b* shows a blowing channel 6',6" whose axis is arranged at an angle a of less than 90° to the longitudinal extent of thread channel 3 and perpendicularly to one surface of upper part 1 of the intermingling assembly.

For embodiments of this invention characterized by the axis of the blowing channel forming an angle a between 90° and 30° with the axis of the thread channel, It is practical for this angle to be 90° for smooth yarns. If an angle of less than 90° is selected for smooth yarns, the multifilament yarn should preferably be fed to the intermingling assembly such that the blowing angle is against the direction of thread movement. If textured multifilament yarns are intermingled, an angle of less than 90° is preferred, whereby it is especially preferred to select the direction of the blowing channel such that the blown air enters the second segment of the thread channel in the direction of thread movement.

Figure 5:
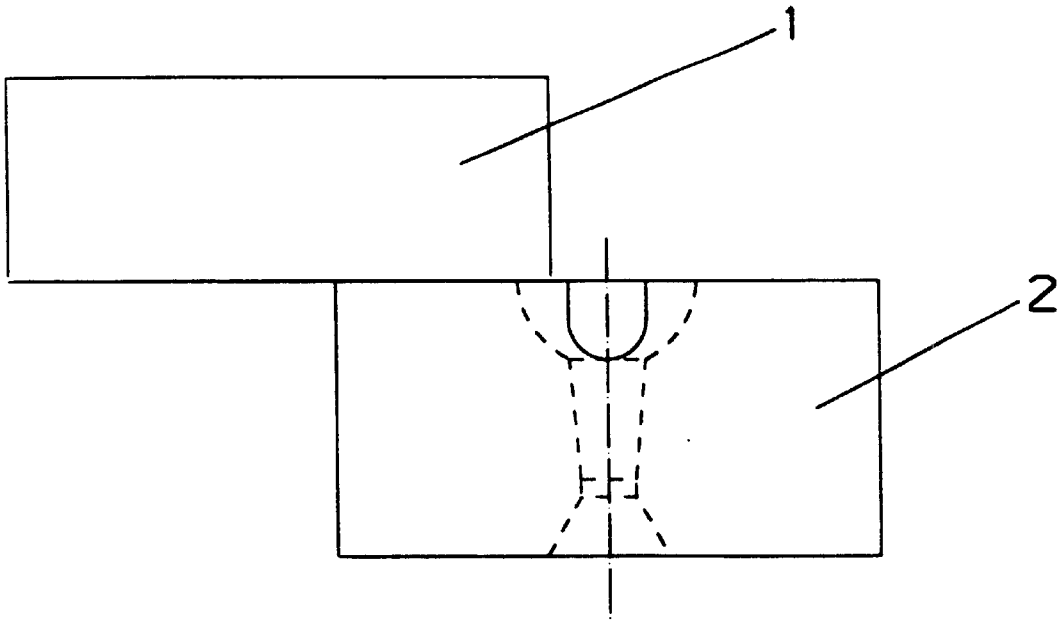
FIG. 5 shows the schematic construction of an intermingling assembly of the invention as a two-piece embodiment in the open state.

FIG. 5 shows one possible embodiment of the intermingling assembly or device of the invention, which is of two-piece construction and can be opened to insert or remove a multifilament yarn. In the depicted embodiment, an upper part 1 of the intermingling assembly of the invention is displaced rearward to enable insertion or removal of a multifilament yarn in the thread channel (not designated) of lower part 2 of the intermingling assembly. To operate the intermingling assembly of the invention, the upper part 1 of the intermingling assembly is then moved to a closed position, as illustrated in FIG. 1*a*, for example. Such apparatus, which were used to open or close texturizing nozzles, are known from WO 97/11214, for example.

Figure 6:
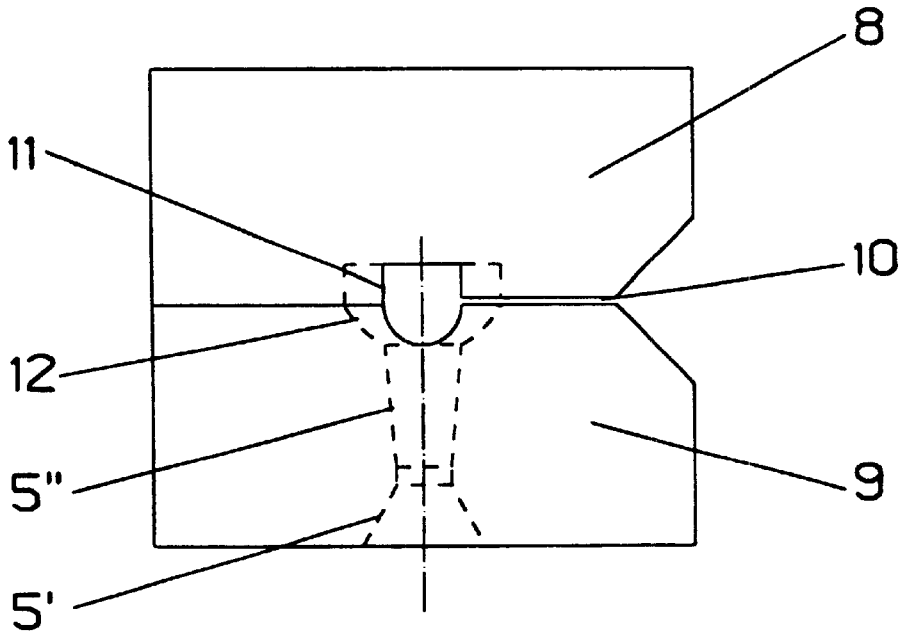
FIG. 6 shows the schematic construction of a closed construction of an intermingling assembly of the invention with a thread insertion slot.

FIG. 6 depicts a one-piece intermingling assembly. To simplify manufacture, an upper part 8 and lower part 9 are produced initially, whereby the two parts 8 and 9 are subsequently joined to each other, either separably using screws, for example, or inseparably using rivets or by gluing. To insert and remove the multifilament thread, this intermingling assembly has a thread insertion slot 10 that runs along the longitudinal side of the intermingling assembly and extends over the entire length up to the thread channel.

FIG. 6 also illustrates that the thread channel does not have to be arranged solely in the lower part 9 of the intermingling assembly but rather that parts of the thread channel can also be embedded in the upper part 8 of the intermingling assembly. In the case illustrated, both thread channel 11 and the expanded thread channel 12 of the second segment of the thread channel are embedded partly in lower part 9 and partly in upper part 8 of the intermingling assembly. The blowing channel in FIG. 6 is designated as 5',5" in accordance with the preceding figures. Although a thread channel divided in this manner is illustrated only for a one-piece construction of the intermingling assembly of the invention, this type of arrangement can also be used in the previously described embodiments.

Figure 7A:
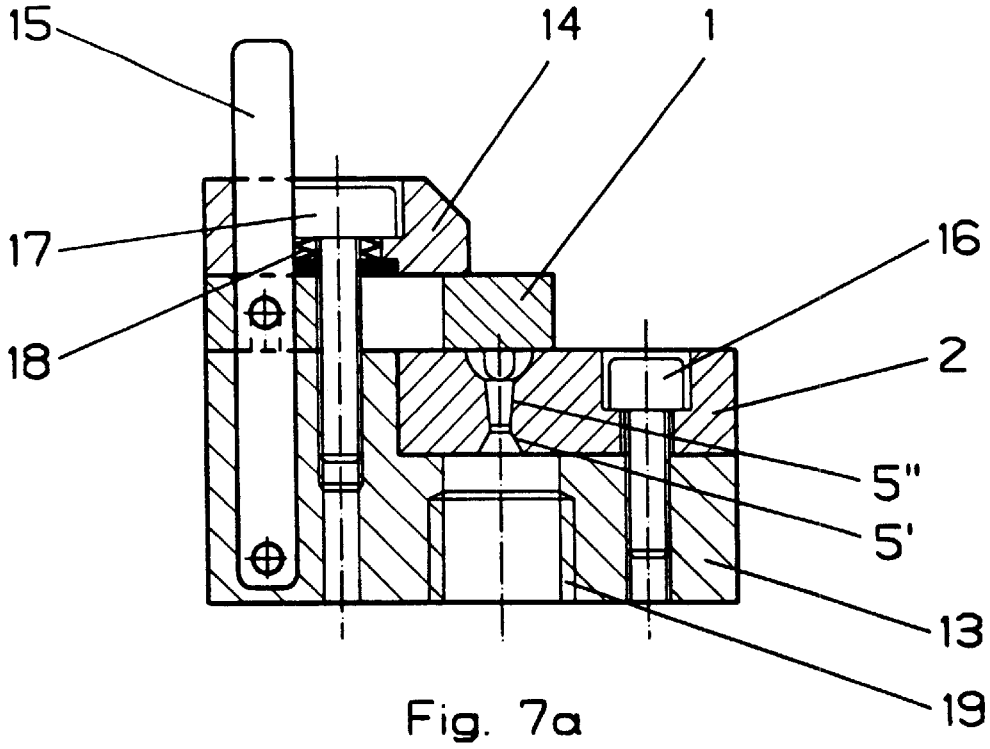
FIG. 7*a* shows a cross-section through an apparatus of the invention in two-piece construction, in the closed state.
Figure 7B:
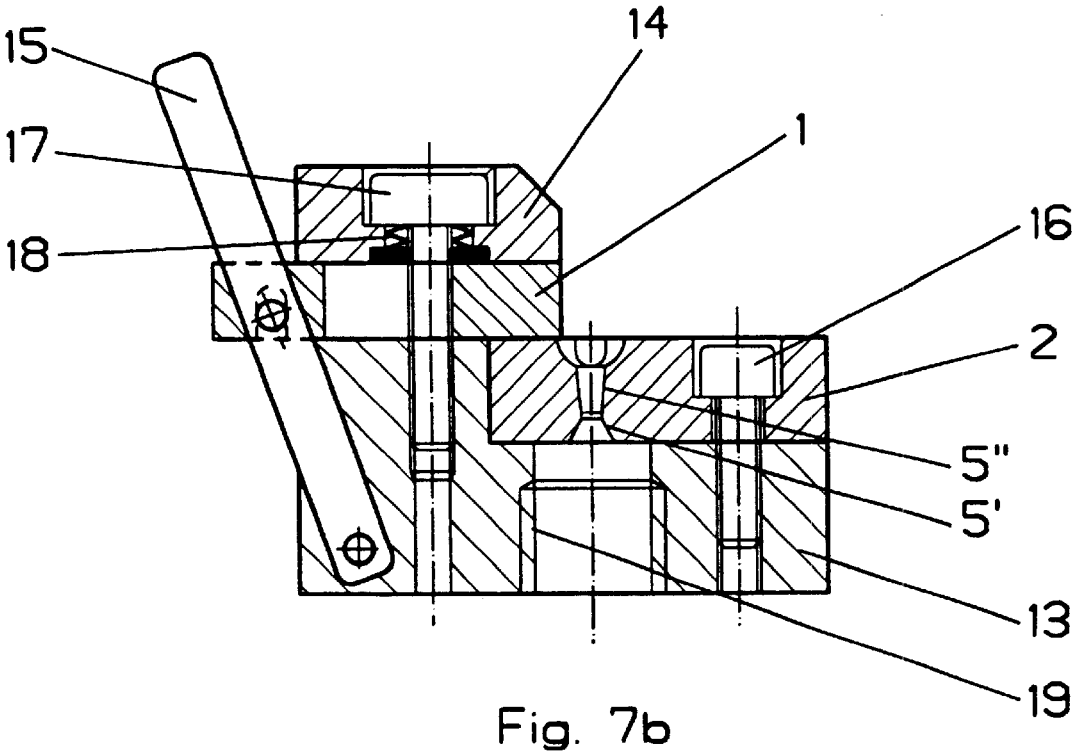
FIG. 7*b* shows a cross-section through an apparatus of the invention in two-piece construction in the open state.

FIGS. 7*a*,7*b* show a cross-section through an apparatus of the invention with two-piece construction in a closed state (FIG. 7*a*) and open state (FIG. 7*b*). An intermingling assembly of the invention, with upper part 1 and lower part 2, is inserted in a support 13. The lower part 2 is attached to the support 13 with screws 16. Compressed air can be supplied to the blowing channel 5',5" via the compressed air port 19.

Via a lever 15, upper part 1 can be moved into the closed position (FIG. 7*a*) or the open position (FIG. 7*b*). Upper part 1 is held by a retaining plate 14, joined to the support 13 using screws 17, and a spring 18.

Figure 8:
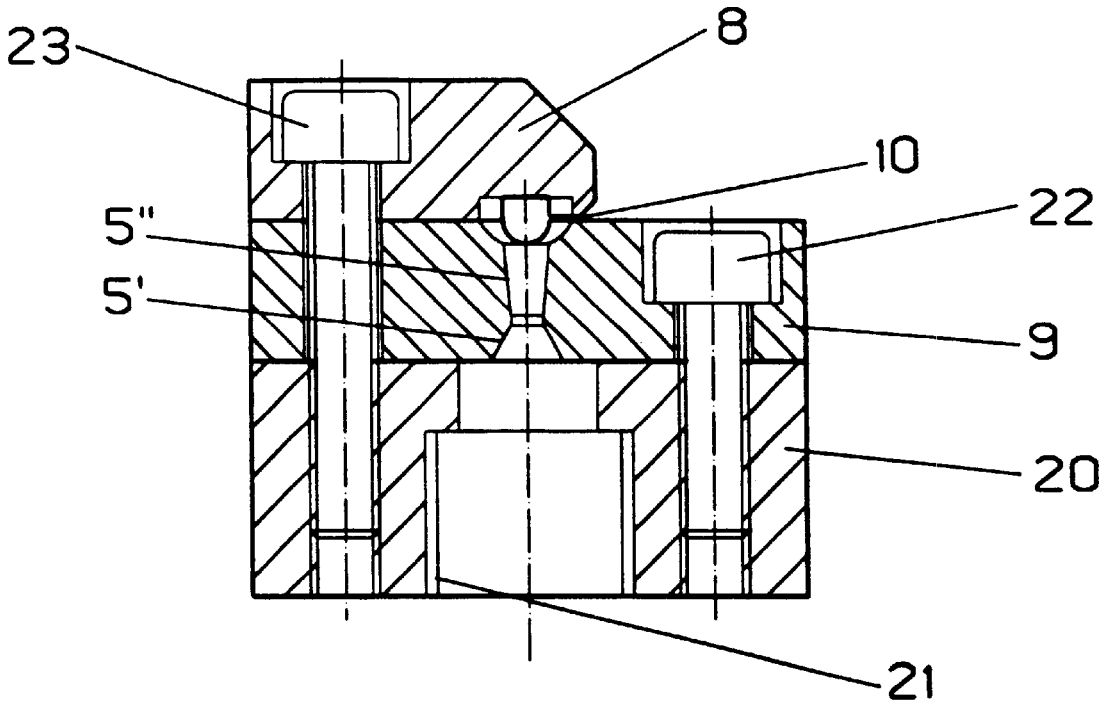
FIG. 8 shows a cross-section through an apparatus of the invention in one-piece construction.

FIG. 8 shows a cross-section through an apparatus of the invention in one-piece construction. The lower part 9 is joined to a support 20 using screws 22. The upper part 8 is likewise joined to support 20 using screws 23 and to lower part 9, whereby upper part 8 and/or lower part 9 are shaped such that, following assembly, a thread insertion slot 10 remains between upper part 8 and lower part 9. In this case as well, compressed air can be supplied via port 21 to the blowing channel 5',5".

Figure 9A:
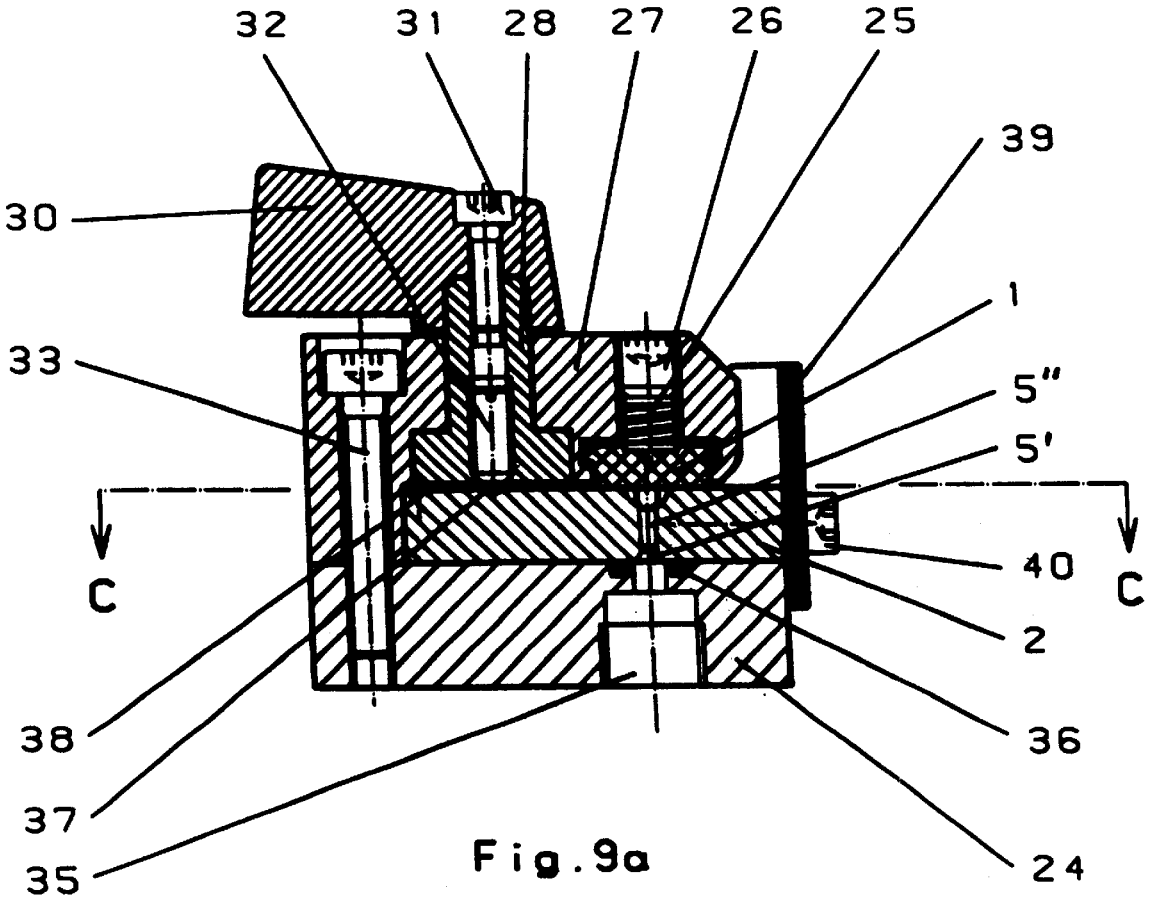
FIG. 9*a* shows a cross-section through a further apparatus of the invention in a two-piece embodiment in the closed state.
Figure 9B:
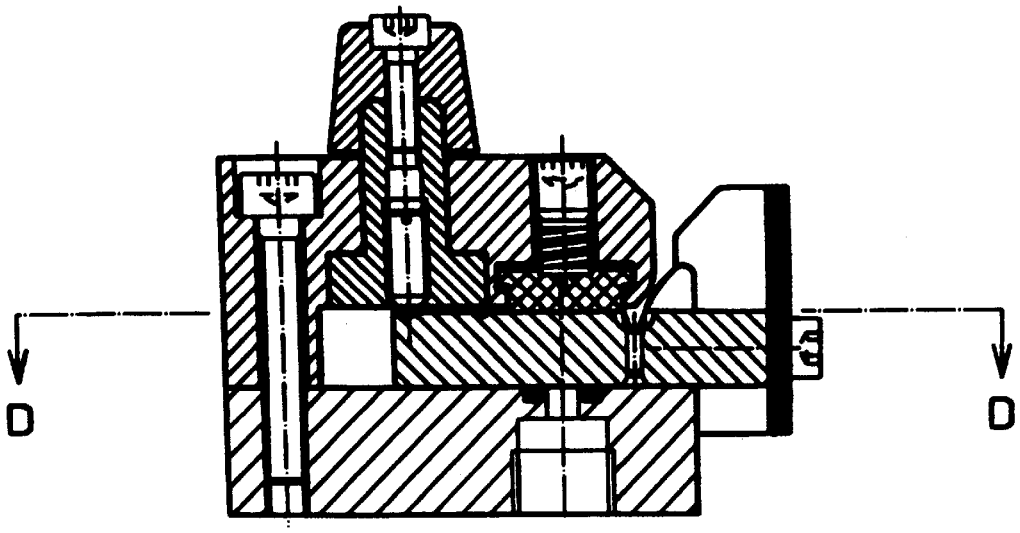
FIG. 9*b* shows the apparatus of FIG. 9*a* in the open state.
Figure 9C:
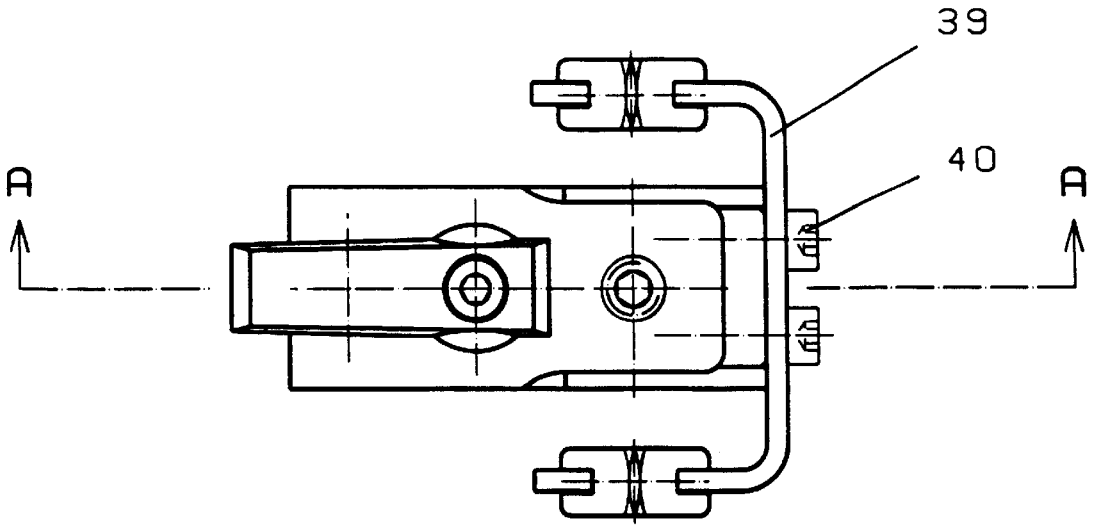
FIG. 9*c* shows a plan view of the apparatus of FIG. 9*a;*
Figure 9D:
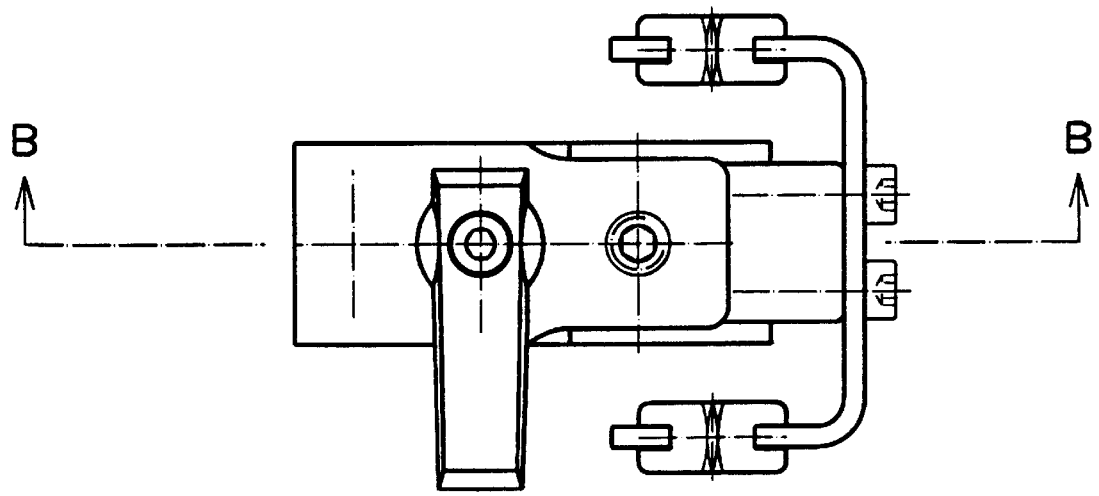
FIG. 9*d* shows a plan view of the apparatus of FIG. 9*b;*

FIGS. 9*c* and 9*d* illustrate a further embodiment of the apparatus of the invention in two-piece construction in the closed state (FIG. 9*c*) and open state (FIG. 9*d*), each in plan view. With respect to this embodiment, FIGS. 9*a* and 9*b* illustrate the cross-cross-sections noted in FIGS. 9*c* and 9*d*, whereby FIG. 9*a* is cross-section AA (FIG. 9*c*) and FIG. 9*b* is cross-section BB (FIG. 9*d*).

The lower part 2 of an intermingling apparatus of the invention is inserted in a base plate 24. The upper part 1 is inserted in a support 27 using a compression spring 25 and a screw 26. Support 27 is joined to base plate 24 using screw 33, thereby holding upper part 1 and lower part 2 of the apparatus of the invention together.

A rotary element 28 is inserted in support 27; the former being joined to a lever 30 using screw 31. A spring-loaded thrust element 32 is threaded into rotary element 28 and engages depression 37 in the closed state and depression 38 in the open state.

Figure 9E:
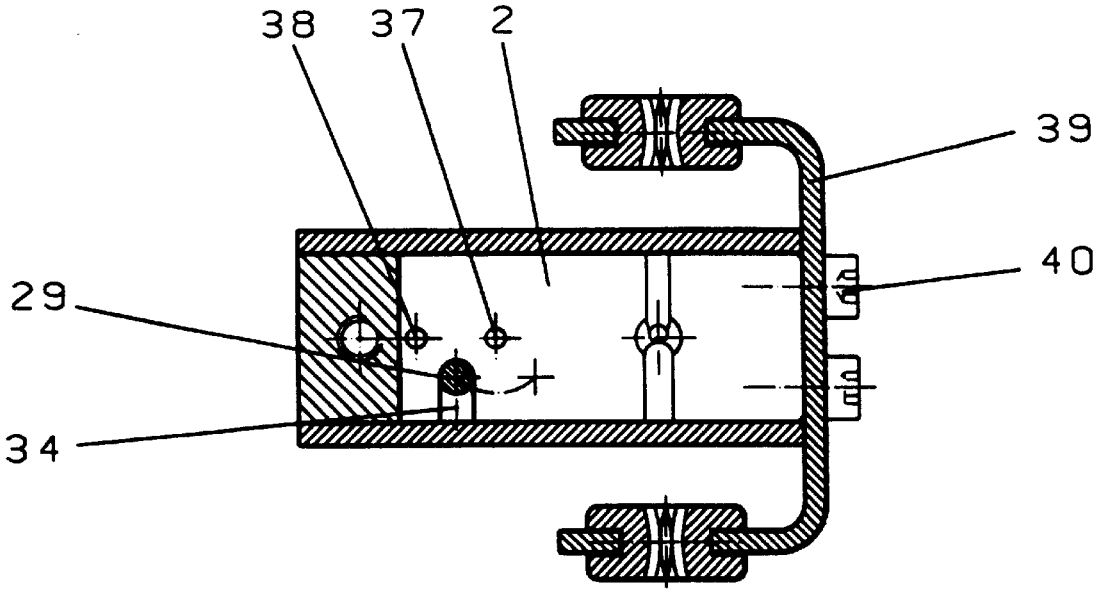
FIG. 9*e* shows cross-section CC of the apparatus of FIG. 9*a*.
Figure 9F:
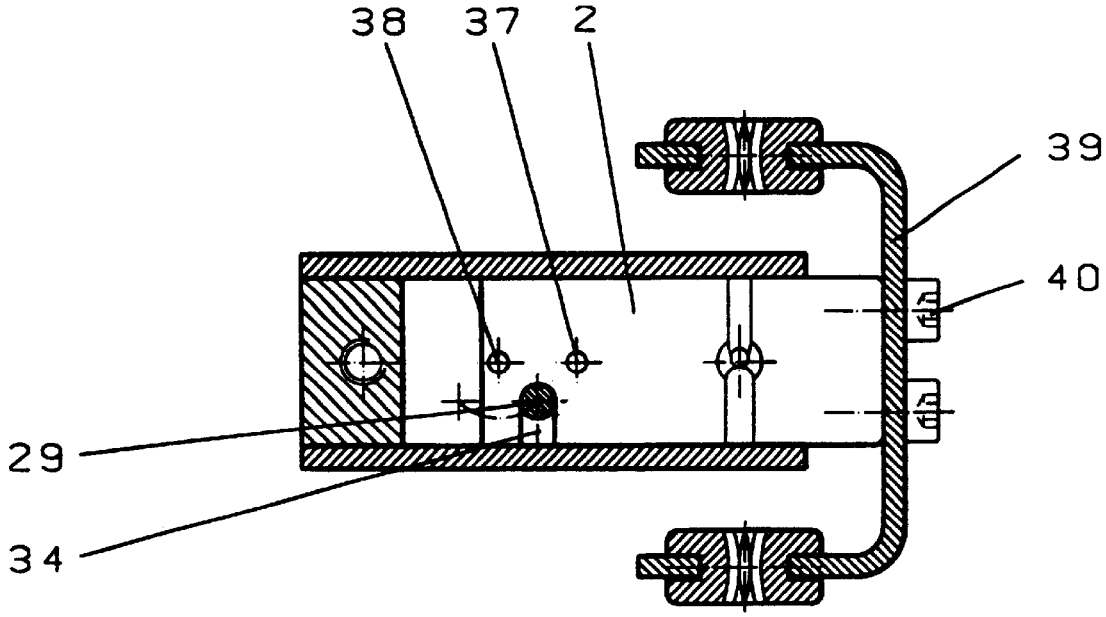
FIG. 9*f* shows cross-section DD of the apparatus of FIG. 9*b*.

Via the lever 30, the apparatus of the invention can be converted to the closed or open state. For better understanding of the mechanism used in this case, cross-section CC according to FIG. 9*a* is shown in FIG. 9*e* and cross-section DD according to FIG. 9*b* in FIG. 9*f*. A pin 29 anchored in rotary element 28 engages an elongated slot 34 in lower part 2. By turning the lever 30, the lower part 2 is brought into the closed position (FIG. 9*e*) or open position (FIG. 9*f*) via pin 29, whereby in the final position thrust element 32 engages depression 37 or 38, respectively.

In the open position (FIGS. 9*b*, 9*d*, 9*f*), the compressed air supplied by supply 35 is blocked by sealing ring 36, and the multifilament yarn can be inserted or removed. By turning back the lever 30, the apparatus is again closed (FIGS. 9*a*, 9*c*, 9*e*) and the blowing channel 5',5" is supplied with compressed air, whereby this position is again fixed by the engagement of the spring-loaded thrust element in depression 37 in lower part 2.

In addition, in FIGS. 9*c*,9*d* (plan view), a thread guide 39 is joined to lower part 2 via screws 40 such that, on opening and closing the apparatus, the thread guide is displaced laterally in the process, resulting in considerably easier handling of the apparatus.

For embodiments of this invention, it is especially satisfactory for the length and width of the second segment to increase concentrically to the opening of the blowing channel, perpendicular to the thread-channel axis.

For embodiments of this invention, it is advantageous for the length and width of the second segment to increase concentrically to the opening of the blowing channel, perpendicular to the thread-channel axis.

For embodiments with the blowing channel opening into the thread channel at an angle of less than 90°, it is advantageous for the length and width of the second segment to increase concentrically to the blowing-channel axis away from the opening of the blowing channel.

For embodiments of this invention, it has proven especially advantageous for the contour of the thread channel in the second segment to be U-shaped at least in the width direction. It is also possible in this case for the sides of the U to be bent outward and the contour of the second segment of the thread channel at least in the width direction to thus have the shape of a parabola whose vertex is then interrupted by the opening of the blowing channel.

Preferably, the contour of the thread channel of the second segment has the form of a spherical cap that is interrupted by the opening of the blowing channel. The term spherical cap is understood to be the partial surface of a sphere formed by cutting away a portion of the spherical surface via a planar cross-section, whereby the distance of the planar cross-section from the most distant point of the spherical surface is at most half the diameter of the spherical surface. If the separation of the planar cross-section from the most distant point of the spherical surface is equal to half the diameter of the spherical surface, the surface is that of a hemisphere.

For embodiments of this invention, the maximum width of the second segment of the thread channel preferably is 1.5 to 3 times greater than the average width of the first and third segments of the thread channel.

Particularly good results are attained if the wall of the second segment of the thread channel opposite the opening of the blowing channel is planar and the axis of the blowing channel is perpendicular to this wall. A particularly intensive intermingling of the filaments of a multifilament yarn is attained with such an apparatus. Making the wall opposite the opening of the blowing channel planar and simultaneously the thread channel expansion in the second segment of the thread channel concentric allows the air coming from the blowing channel to strike perpendicularly onto the planar wall acting as a baffle, resulting in an eddy in the form of two equally sized substreams rotating in opposite directions. A particularly intensive intermingling of the filaments of the multifilament yarn is achieved in this manner.

For embodiments of this invention, the wall opposite the opening of the blowing channel is preferably planar in all segments of the thread channel.

The increase in cross-cross-section of the blowing channel preferably takes the form of a conical frustum, whereby the cross-cross-section of the blowing channel preferably undergoes an initial reduction and, after a cross-cross-section minimum, begins to increase.

It is especially preferred, however, for the blowing channel to have the form of a Laval nozzle.

For embodiments of this invention, particularly good flow properties are exhibited if the cross-cross-sectional area of the blowing channel at the opening into the thread channel is 1.2 to 3 times the area of the narrowest cross-cross-section of the blowing channel.

In general, the thread channel has a constant cross-cross-section in the first and third segments. It can prove practical in this case for the thread channel to initially have a larger cross-cross-section at the entry side into the intermingling assembly, which then narrows to the actual thread channel cross-cross-section. Likewise, the thread channel can be expanded at the exit side of the intermingling assembly. It can also be practical for the cross-cross-section of the thread channel in the first segment to be smaller or larger than that in the third segment. In the intermingling of textured multifilament yarns, the average thread channel cross-cross-section in the first segment is preferably on average smaller than in the third or last segment. It can also be practical, however, for the cross-cross-section of the first segment of the thread channel to increase continuously and for this increase to continue in the third segment. In the embodiments just described, however, it is essential in any case for the thread-channel cross-cross-section in the second segment to be larger than in the first and third segments.

If the intermingling assembly contains at least two blowing channels, the apparatus of the invention is characterized in particular by the third segment of the thread channel with respect to a preceding blowing channel being the first segment of the thread channel with respect to a succeeding blowing channel. It has proven especially satisfactory if the first and third segments of the thread channel have the same length. In the case of at least two blowing channels, this means that the length of the thread channel on the entry side of the intermingling assembly, the length of the thread channel between two adjacent blowing-channel openings, and the length of the thread channel on the exit side of the intermingling assembly are the same.

In principle, the intermingling assembly of this invention can be in one piece or in two or more pieces and assembled after manufacture, possibly inseparably. In such embodiments, it is practical for the intermingling assembly to have a lateral slot extending up to the thread channel, via which slot the multifilament yarn is introduced and can be removed. In this case, the apparatus of the invention is characterized in that the intermingling assembly comprises first and second parts and a thread insertion slot is arranged along the longitudinal side of the intermingling assembly. In this case, the first and second parts of the intermingling assembly can preferably be designed such that the thread insertion slot is arranged between the first and second parts of the intermingling assembly.

However, the intermingling assembly is preferably constructed in two pieces. This facilitates the insertion of the multifilament yarn into the thread channel, since this can easily be done by opening the two-part intermingling assembly.

The thread channel in the first and third segments has the shape of a groove, whose open side is delimited by a planar wall, and the opening of the blowing channel in the second segment is preferably arranged in the plane of the groove base of the first and third segments of the thread channel. In this case, the cross-cross-section of the groove of the thread channel is preferably U-shaped.

To facilitate manufacture, the intermingling assembly may be constructed in two parts such that a first part has the blowing channel and the groove and the second part is a flat plate that allows the groove to be covered.

To facilitate insertion and removal of the multifilament yarn to be intermingled, the intermingling assembly may consist of first and second parts, whereby the thread channel can, by displacing or rotating the first and/or second parts, be converted to an open position for inserting and removing the multifilament thread and a closed position for intermingling the multifilament thread.

The invention will be explained in more detail using the following examples.

COMPARATIVE EXAMPLE

A known intermingling assembly was employed, as described in WO 82/00668, for example. The selected intermingling assembly has a thread channel with a constant, U-shaped cross-section, a length of 15 mm, a height of 2 mm, and a width of 2 mm. A blowing channel opened into the vertex of the thread channel in the middle of the thread channel, the blowing channel having the shape of a Laval nozzle, a cross-sectional area at its narrowest point of 1.54 mm2 and at the opening into the thread channel of 2.1 mm2, and a length of 5 mm. The wall of the thread channel opposite the opening was planar. The axis of the blowing channel formed an angle of 80° with the axis of the thread channel on the thread entry side.

Two textured filament yams were inserted into an intermingling assembly of this type, each yarn having 36 filaments, each of these filaments having an individual titer of 4.7 dtex. For intermingling, the yam was drawn through the intermingling assembly at a rate of 700 m/min., whereby the required compressed air was supplied to the blowing channel at a pressure of 4.5 bar.

On the yarn so intermingled, the fixed points per meter, mean opening length, standard deviation, and maximum opening length were determined. To simulate stressing of this intermingled yarn, the yarn was elongated by 2%, 2.3%, 2.6%, and 3.5%, respectively, of its original length, and the aforementioned measurements were repeated. The measurements are summarized in the following Table 1.

TABLE 1

| Elongation [%] | 0 | 2.0 | 2.3 | 2.6 | 3.5 |
|---|---|---|---|---|---|
| Fixed points per meter | 102 | 96 | 89 | 63 | 20 |
| Mean opening length [cm] | 0.98 | 1.04 | 1.11 | 1.59 | 5.0 |
| Standard deviation [cm] | 0.34 | 0.47 | 0.64 | 1.87 | 10.0 |
| Maximum opening length [cm] | 4.4 | 6.8 | 9.6 | 28 | 99 |

EXAMPLE

The nozzle used in the comparative example was modified in that the thread channel was drilled concentrically to the blow-channel axis of the thread channel, up to the thread channel base, using a hemispherically shaped drill with a diameter of 4 mm. The yarns used and intermingling conditions were selected as in the comparative example. The properties measured on the intermingled yarn are shown in table 2.

TABLE 2

| Elongation [%] | 0 | 2.0 | 2.3 | 2.6 | 3.5 |
|---|---|---|---|---|---|
| Fixed points per meter | 102 | 102 | 100 | 98 | 89 |
| Mean opening length [cm] | 0.98 | 0.98 | 1.0 | 1.02 | 1.13 |
| Standard deviation [cm] | 0.23 | 0.23 | 0.28 | 0.33 | 0.59 |
| Maximum opening length [cm] | 3.5 | 3.5 | 4.3 | 5.1 | 8.7 |

In comparing the results, it can be noted that, compared to the prior art, the standard deviation and maximum opening length were improved on the unstressed yarn. In addition, it is clear that in the case of subsequent stressing, which in this case was simulated by elongation, the intermingling quality of the yarn was improved significantly when the intermingling was conducted using an apparatus of the invention.

What is claimed is:

1. An apparatus for intermingling multifilament yarns, comprising:

an intermingling device having a thread channel and a blowing channel having an opening that intersects the thread channel;

the blowing channel being capable of receiving compressed air and having a cross-section that increases in the direction of the thread channel;

the thread channel having a first segment before the opening of the blowing channel, a second segment in the area of the opening of the blowing channel and a third segment after the opening of the blowing channel;

the first, second and third segments of the thread channel have a cross-sectional area in a direction perpendicular to an axis of the thread channel; and the cross-sectional area of the second segment is greater than the cross-sectional areas of the first and third segments.

2. An apparatus as recited in claim 1, wherein:

the thread channel includes a wall opposite the opening of the blowing channel; and the second segment has a width in a direction substantially perpendicular to the axis of the thread channel that increases in a direction toward the wall.

3. An apparatus as recited in claim 1, wherein:

the thread channel includes a wall opposite the opening of the blowing channel; and the second segment has a length in a direction substantially parallel to the axis of the thread channel, the length increases in a direction toward the wall.

4. An apparatus as recited in claim 1, wherein:

the second segment has a width in a direction substantially perpendicular to the axis of the thread channel;

the second segment has a length in a direction substantially parallel to the axis of the thread channel; and the length and width of the second segment increase to the opening of the blowing channel in a direction substantially perpendicular to the axis of the thread channel.

5. An apparatus as recited in claim 1, wherein:

the second segment has a width in a direction substantially perpendicular to the axis of the thread channel;

the second segment has a length, in a direction substantially parallel to the axis of the thread channel; and the length and width of the second segment increase to an axis of the blowing channel away from the opening of the blowing channel.

6. An apparatus as recited in claim 1, wherein:

the thread channel has a width, in a direction substantially perpendicular to the axis of the thread channel; and the thread channel has a contour that is U-shaped at least in the direction of the width of the thread channel.

7. An apparatus as recited in claim 1, wherein:

the second segment of the thread channel has a contour generally shaped as a partial spherical cap interrupted by the opening of the blowing channel.

8. An apparatus as recited in claim 1, wherein:

the first and third segments have an average width in a direction substantially perpendicular to the axis of the thread channel;

the second segment has a maximum width in a direction substantially perpendicular to the axis of the thread channel; and the maximum width of the second segment is 1.5 to 3.0 times greater than the widths of the first and third segments.

9. An apparatus as recited in claim 1, wherein:

the thread channel includes a wall opposite the opening of the blowing channel;

the wall in the second segment of the thread channel is planar; and the blowing channel has an axis that is substantially perpendicular to the wall.

10. An apparatus as recited in claim 9, wherein:

the wall is planar in the first and third segments of the thread channel.

11. An apparatus according to claim 1, wherein:

the blowing channel has an axis that is at an angle between about 30 degrees and about 90 degrees with the axis of the thread channel.

12. An apparatus according to claim 1, wherein:

the cross-section of the blowing channel is the form of a conical frustum.

13. An apparatus according to claim 1, wherein:

the blowing channel includes a cross-section minimum intermediate its length; and the cross-section of the blowing channel, in the direction of the thread channel, decreases from one end to the cross-section minimum and increases from the cross-section minimum to a second end intersecting the thread channel.

14. An apparatus according to claim 1, wherein:

the blowing channel is a laval nozzle.

15. An apparatus according to claim 1, wherein:

the cross-section of the blowing channel at the opening has an area that is about 1.2 to about 3 times greater than a narrowest part of the cross-section of the blowing channel.

16. An apparatus according to claim 1, wherein:

the first segment has a cross-section that increases in the direction of the second segment.

17. An apparatus according to claim 1, wherein:

the third segment has a cross-section area average; and the first segment has a cross-section area average that is less than the cross-section area average of the third segment.

18. An apparatus according to claim 1, wherein:

the intermingling device further comprises a second thread channel and a second blowing channel having an opening that intersects the second thread channel;

the second thread channel having a first segment before the opening of the second blowing channel, a second segment in the area of the opening and a third segment after the opening; and the third segment of the first thread channel is the first segment of the second thread channel.

19. An apparatus according to claim 1, wherein:

the first segment has a length;

the third segment has a length; and the length of the first segment is about equal to the length of the third segment.

20. An apparatus according to claim 1, wherein:

the thread channel in the first and third segments has a groove shape opposed by a planar wall; and the opening of the blowing channel is arranged in a plane corresponding to a base of the groove shape of the thread channel.

21. An apparatus according to claim 20, wherein:

the cross-section of the groove shape is U-shaped.

22. An apparatus according to claim 1, wherein:

the intermingling device is made of a first part and a second part.

23. An apparatus according to claim 20, wherein:

the intermingling device is made of a first part and a second part;

the first part includes the blowing channel and the groove shape of the thread channel; and the second part is a flat plate forming the planar wall of the thread channel to cover the groove shape.

24. An apparatus according to claim 23, wherein:

the first and second parts of the intermingling device rotate relative to one another to an open position for inserting and removing a multifilament thread into the thread channel and a closed position for intermingling the multifilament thread.

25. An apparatus according to claim 23, further comprising:

a thread insertion slot located along a longitudinal side of the intermingling apparatus and communicating with the thread channel.

26. A method of intermingling multifilament yarns comprising:

providing an intermingling device having a thread channel and a blowing channel having an opening that intersects the thread channel;

the blowing channel being capable of receiving compressed air and having a cross-section that increases in the direction of the thread channel;

the thread channel having a first segment before the opening of the blowing channel, a second segment in the area of the opening of the blowing channel and a third segment after the opening of the blowing channel;

the first, second, and third segments of the thread channel have a cross-sectional area in a direction perpendicular to an axis of the thread channel; and the cross-sectional area of the second segment is greater than the cross-sectional areas of the first and third segments;

inserting a multifilament yarn in the thread channel of the intermingling device;

drawing the multifilament yarn through the thread channel at a predetermined rate; and blowing compressed air into the blowing channel at a predetermined pressure to intermingle the multifilament yarn.

* * * * *